US009887498B2

(12) United States Patent
Shan et al.

(10) Patent No.: US 9,887,498 B2
(45) Date of Patent: Feb. 6, 2018

(54) COMPACT PROTECTION DEVICE FOR AUTOMOTIVE CIGAR LIGHTER AND POWER OUTLET

(71) Applicants: Yanmin Shan, Jiangsu Province (CN); Steven Cai, Orange, CT (US); Roger Higgott, Valgioie (IT)

(72) Inventors: Yanmin Shan, Jiangsu Province (CN); Steven Cai, Orange, CT (US); Roger Higgott, Valgioie (IT)

(73) Assignee: CASCO PRODUCTS CORPORATION, Wallingford, CT (US)

( * ) Notice: Subject to any disclaimer, the term of this patent is extended or adjusted under 35 U.S.C. 154(b) by 0 days.

(21) Appl. No.: 14/991,324

(22) Filed: Jan. 8, 2016

(65) Prior Publication Data

US 2017/0201049 A1 Jul. 13, 2017

(51) Int. Cl.
*H01R 13/68* (2011.01)
*H01R 13/713* (2006.01)

(52) U.S. Cl.
CPC ..... *H01R 13/68* (2013.01); *H01R 13/7137* (2013.01)

(58) Field of Classification Search
CPC ..... H01R 13/68; H01R 13/7137
(Continued)

(56) References Cited

U.S. PATENT DOCUMENTS 2,883,510 A * 4/1959 Krautwurst ..... B60N 3/14 219/264
4,459,464 A 7/1984 Oda et al.
(Continued)

FOREIGN PATENT DOCUMENTS

JP 9-309371 2/1997
JP 2000-243200 9/2000

OTHER PUBLICATIONS

Combined Search and Examination Report dated Mar. 15, 2017 in related United Kingdom Patent Application No. GB1619849.1.
(Continued)

*Primary Examiner* — Alexander Gilman
(74) *Attorney, Agent, or Firm* — Ostrolenk Faber LLP

(57) ABSTRACT

An electrical outlet has a conductive socket well for slidably receiving an electrical plug, the well having a transverse distal end having a center hole; an insulating connector housing adjacent the transverse distal end of the socket well having at least two electrical terminals for connection to an electrical supply; a first of the electrical terminals being coupled to a central fastener and a second of the electrical terminals terminating in a conductive element adjacent the transverse end of the socket well; a fuse member provided between the transverse end of the socket well and the conductive element, the fuse member in series electrical connection between the conductive element and the socket well; the fuse member providing compact integral over-current protection; an insulator disposed at the distal end of the socket well in the socket well, the central fastener holding the socket well, the insulator, the fuse member, insulating connector housing and first and second electrical terminals together as a unit; a proximal end of the central fastener providing a first electrical contact insulated from said socket well and the socket well providing a second electrical contact for electrically contacting with respective contacts of the electrical plug received in the socket well. The electrical outlet is also preferably provided with integral over-temperature protection, preferably comprising a spring-loaded leaf spring impinging on a thermoplastic disc that softens at a threshold temperature, allowing the leaf spring to penetrate through the disc and short-circuit the electrical supply.

27 Claims, 9 Drawing Sheets

(58) Field of Classification Search
USPC ..... 439/620.21, 620.22, 535, 652, 754, 439/620.12; 337/297, 397; 361/58, 104
See application file for complete search history.

(56) References Cited

U.S. PATENT DOCUMENTS 4,500,774 A * 2/1985 Honjo ..... F23Q 7/00 219/265
4,713,733 A * 12/1987 Fitz ..... B60N 3/14 219/220
5,044,993 A * 9/1991 El-Haj ..... H01R 24/58 29/876
5,173,593 A * 12/1992 Ogino ..... F23Q 7/00 219/264
5,233,162 A * 8/1993 von Gaisberg ..... F23Q 7/00 219/265
5,403,996 A * 4/1995 Mattis ..... F23Q 7/00 219/265
5,493,098 A * 2/1996 Diederich ..... B60N 3/14 219/265
5,831,246 A * 11/1998 Thivet ..... B60N 3/14 219/265
5,900,172 A * 5/1999 Thivet ..... B60N 3/14 219/265
5,928,538 A * 7/1999 Thivet ..... B60N 3/14 219/264
5,932,126 A * 8/1999 Thivet ..... B60N 3/14 219/265
5,998,763 A * 12/1999 Mattis ..... B60N 3/14 219/263
6,051,814 A * 4/2000 El-Haj ..... B60N 3/14 219/262
6,147,850 A * 11/2000 Gronowicz, Jr. ..... H01C 7/021 361/103
6,239,977 B1 * 5/2001 Price ..... H01C 1/1406 337/297
6,445,277 B1 * 9/2002 Ishikawa ..... H01C 7/12 337/290
6,459,558 B1 * 10/2002 Hashizawa ..... H01H 85/54 337/186
6,476,359 B2 * 11/2002 Rostan ..... B60N 3/14 219/265
6,563,088 B1 * 5/2003 Wolf ..... B60N 3/14 219/264
6,682,356 B2 * 1/2004 Erez ..... H01R 13/4538 439/108
6,740,850 B2 * 5/2004 Mattis ..... B60N 3/14 219/265
6,947,271 B1 * 9/2005 Gronowicz, Jr. ..... H01C 7/02 361/93.1
7,121,897 B2 * 10/2006 Beski ..... B60N 3/14 219/267
7,193,182 B2 3/2007 Can et al.
7,616,420 B2 * 11/2009 Slater ..... H02H 9/042 361/103
8,215,999 B2 * 7/2012 Lau ..... H01R 13/743 439/668
8,441,109 B2 * 5/2013 Herbert ..... H01L 23/3135 257/355
8,496,854 B2 * 7/2013 Mercx ..... C08L 23/04 252/500
8,508,327 B2 * 8/2013 Chen ..... H01C 7/027 338/13
8,937,524 B2 * 1/2015 de Leon ..... H01H 85/0418 29/623
9,099,801 B2 * 8/2015 Holland ..... H01R 13/44
9,099,818 B2 * 8/2015 Ikeda ..... H01R 24/38
2001/0051460 A1 * 12/2001 Ota ..... H01R 24/58 439/558

OTHER PUBLICATIONS

Internal Document 15414 i 8 showing the overall design, Jul. 7, 1992.
Casco Details of thermal protection device, May 17, 2007.
Internal Document 8139313 showing the thermoplastic disc, Oct. 20, 1989.
Internal Document 6309068 showing the leaf spring, Dec. 13, 1982.
Korean Office Action and English translation dated Nov. 17, 2017 in related Korean Patent Application No. 10-2017-0002406.

* cited by examiner

COMPACT PROTECTION DEVICE FOR AUTOMOTIVE CIGAR LIGHTER AND POWER OUTLET

BACKGROUND OF THE INVENTION

The present invention relates to electrical power outlets and cigar lighter outlets, and in particular, to electrical power outlets and cigar lighter outlets, receptacles or sockets for use in automotive applications. More particularly, the present invention is related to a compact protection device for automotive cigar lighter sockets and electrical power outlets and provides protection against overheating and over-current conditions.

The trend in automotive design is for increased use of electronic devices that require more power and draw higher currents from the power outlets or cigar lighter sockets in motor vehicles.

Two common issues result. One is over-current, that is, excessive current draw due to excessive power consumption or a short circuit in the plugged-in device. Another is overheating due to high current and often poor quality of after-market accessory plugs that cannot handle the currents drawn through them.

In the past, over-current protection has been provided by using a fuse that is installed in the vehicle fuse box. This fuse is accessible to the vehicle operator and often times, such vehicle operators are inexperienced, particularly with electrical matters and may replace a blown fuse with a fuse of the wrong type, for example, a higher current fuse which will no longer provide proper over-current protection, leading to excessive current draw which can damage the vehicle wiring and/or the accessory device and, in a worst case, cause a fire or injury.

Over-temperature or overheating protection has been provided in cigar lighters in automotive vehicles typically by providing a second bimetallic element, in addition to the bimetallic thermostatic element that disconnects the cigar lighter from the electrical current when it has been heated to ignition temperature. Typically, the additional bimetallic thermostatic element responds to excessive heating and short-circuits the power to the cigar lighter socket in the vehicle, which then blows the fuse provided in the vehicle fuse box. Such over-temperature protection for vehicle cigar lighters operates adequately when the heat build-up is fast but does not adequately operate for cigar lighters when they are used as power outlets in which the heat build-up is much slower. In such case, the additional bimetallic element will fail to provide short-circuit protection.

For power outlets in automotive vehicles that are not equipped as cigar lighter outlets, typically over-temperature protection has not been provided.

SUMMARY OF THE INVENTION

It is an object of the present invention to provide a compact over-current protection device for an automotive power outlet and/or automotive cigar lighter socket. According to the invention, the over-current protection device is located compactly within the power outlet/cigar lighter socket.

It is furthermore an object of the invention to provide an automotive power outlet/cigar lighter socket that provides effective over-temperature protection both in power outlets not equipped as cigar lighter outlets for electronic devices plugged into the outlets and for the sockets of cigar lighters.

The over-current protection is preferably implemented using a fast-action surface mount fuse mounted on a printed circuit board (PCB) which is integrated into the cigar lighter outlet or power outlet. This is believed to be unique since the other known available solutions for fuse mounting in or on the socket rely on a more conventional mechanical assembly.

The over-current protection according to the invention is compact in size and increases the overall length of the existing products by no more than a few millimeters and, in particular, by only about 1.6 millimeters or so. This is unique in terms of minimum impact to product size increase and maximizes compatibility with existing manufacturing processes when compared with other available solutions.

The surface mount fuse using surface mount technology (SMT) is small in size and enclosed in or adjacent to the connector housing at the back or distal end of the cigar lighter outlet or power outlet. Thus, the fuse itself is protected against damage or tampering, unlike other available solutions. In addition, since the surface mount fuse is enclosed and contained in or near the connector housing, when it blows, any effects due to arcing and melting are confined to that space.

The rating of the surface mount fuse in the outlet/socket is customizable by the manufacturer. The preferred rating is that the outlet integrated fuse does not blow during normal use. It only blows when the current exceeds its specified rating for the outlet and, when it does blow, it acts faster than the fuse in the vehicle fuse box does. Therefore, the over-current protection of the outlet is guaranteed and independent of the vehicle side fuse which can be tampered with or changed with an inappropriately sized fuse by an inexperienced user.

The over-temperature protection is preferably implemented using a spring biased electrically and heat conductive device, for example, a metal leaf spring, and a thermoplastic disc. The leaf spring is electrically and mechanically connected to the center electrical contact of the socket which is normally the positive side contact connected to the positive side of the vehicle DC electrical supply. The leaf spring preferably has two transverse contact legs spring loaded onto the thermoplastic disc that rests on the bottom of the metal socket which acts as the negative contact of the socket. In the event of overheating, the plastic disc softens and melts, acting as a thermal fuse. The leaf spring legs penetrate through the thickness of the thermoplastic disc and short-circuit to the metal socket. The short-circuiting further triggers over-current protection which can be provided by the outlet integrated fuse according to the invention or if not so provided, the vehicle side fuse (or other circuit interrupter, e.g., a circuit breaker) provided in the automotive fuse/circuit breaker box in the traditional case, depending on the manufacturer's preference.

The advantages of the outlet integrated fuse described above also apply in the case of over-temperature protection. That is, if the socket according to the invention is provided with the over-temperature protection, e.g., in the preferred embodiment, the leaf spring that short-circuits through the thermoplastic disc, and is also provided with the outlet integrated fuse, the short-circuiting of the leaf spring through the thermoplastic disc to the outlet/socket metal shell will then cause the integrated fuse to blow thereby providing the over-temperature protection. Since the outlet integrated fuse is provided in the negative return side of the socket/outlet, when the short-circuit is made by the leaf spring penetrating through the thermoplastic disc due to over-temperature, the short-circuit will cause the outlet integrated fuse also to blow.

The material of the thermoplastic disc is selected such that its melting point is above normal use maximum environmental temperatures and below the maximum protection temperature that is required. The leaf spring should be designed such that it adequately makes contact with the metal socket when the thermoplastic disc is penetrated after softening and melting to cause a short-circuit. The metal leaf spring and thermoplastic disc are contained inside the metal shell of the socket/outlet. The leaf spring should be positioned to be close to the top of the center rivet and mechanically and electrically in contact with the center rivet and insulated from the socket shell. The heat conduction from the heat source, i.e., the accessory plug, to the leaf spring is faster and more effective than any other available solutions that rely on a thermal fuse located typically at the back side of the socket which is away from the heat source. In contrast to these available solutions, because the leaf spring is located inside the socket and close to the heat source, the over-temperature protection is faster than these prior art designs. A significant drawback of the prior art designs is that the thermal fuse, because it is located at the rear of the socket, is not near the heat source.

According to one aspect, the invention comprises an electrical outlet comprising an electrically conductive socket well for slidably receiving an electrical plug, the well having a transverse distal end having a center hole; an insulating connector housing adjacent the transverse end of the socket well having at least two electrical terminals for connection to an electrical supply; a first of the electrical terminals being coupled to a central fastener and a second of the electrical terminals terminating in an electrically conductive element adjacent the transverse distal end of the socket well; a fuse member being provided between the transverse distal end of the socket well and the conductive element, the fuse member in series electrical connection between the conductive element and the socket well, the fuse member providing an electrical conduction path between the second electrical terminal and the socket well, further comprising an insulator disposed at the distal end of the socket well in the socket well, the central fastener holding the socket well, the insulator, the fuse member, insulating connector housing and first and second electrical terminals together as a unit; a proximal end of the central fastener providing a first electrical contact insulated from said socket well and the socket well providing a second electrical contact for electrically contacting with respective contacts of the electrical plug received in the socket well; the fuse member providing integral over-current protection for the electrical outlet.

In a preferred embodiment, the fuse member comprises an insulating member having first and second electrically conductive sides and a fuse element in series connection with the first and second electrically conductive sides, the first and second electrically conductive sides being in respective electrical contact with the socket wall and the conductive element, the conductive element comprising a planar conductive element.

Preferably the insulating member is a printed circuit board (PCB) and the fuse element is surface mount technology (SMT).

In a preferred embodiment, the electrical outlet also employs integral over-temperature protection.

According to another aspect, the invention comprises an electrical outlet comprising a conductive socket well for slidably receiving an electrical plug, the well having a transverse distal end having a center hole; an insulating connector housing adjacent the transverse end of the socket well having at least two electrical terminals for connection to an electrical supply; a first of said electrical terminals being coupled to a central fastener and a second of said electrical terminals in electrical contact with the socket well; further comprising an insulator disposed at the distal end of the socket well in the socket well, the central fastener holding the socket well, the insulator, the insulating connector housing and first and second electrical terminals together as a unit; a proximal end of the central fastener providing a first electrical contact insulated from said socket well and the socket well providing a second electrical contact for electrically contacting with respective contacts of the electrical plug received in the socket well; further comprising a thermoplastic insulating disc at the distal end of the socket well mounted between the insulator in the socket well and the transverse distal end of the socket well and being held in place by the central fastener disposed through a central hole of the thermoplastic insulating disc, further comprising a spring-loaded member electrically and mechanically connected to the central fastener and held in place in the insulator by the central fastener, the spring-loaded member biased against the thermoplastic insulating disc, the thermoplastic insulating disc having a melting point above a normal temperature range of use of the electrical outlet but below a threshold maximum temperature, whereby the thermoplastic insulating disc will soften at the maximum temperature and the spring-loaded member biased against the thermoplastic insulating disc will form an electrically conductive path through the thermoplastic insulating disc and electrically engage the transverse distal end of the socket well thereby short circuiting the electrical supply and causing circuit interruption to provide over-temperature protection.

In a preferred embodiment, the spring-loaded member comprises a leaf spring having first and second transverse arms and right angle ends directed to the thermoplastic disc for penetrating through the thermoplastic disc when the disc softens at the threshold maximum temperature, the right angle ends having contact points for electrically engaging with the transverse distal end of the socket well when the thermoplastic disc softens, further wherein the leaf spring has a center hole for electrical and mechanical engagement by the central fastener.

In a further preferred embodiment, the electrical outlet also employs integral over-current protection and the circuit interruption is by an integral fuse member.

Other objects, features and advantages of the present invention will be apparent from the detailed description which follows.

BRIEF DESCRIPTION OF THE DRAWING(S)

The invention will be described in greater detail in the following detailed description with reference to the drawings in which.

Figure 14:
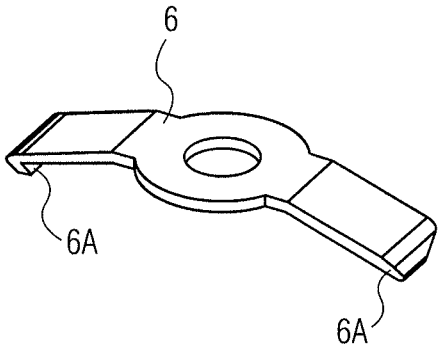
Figure 15:
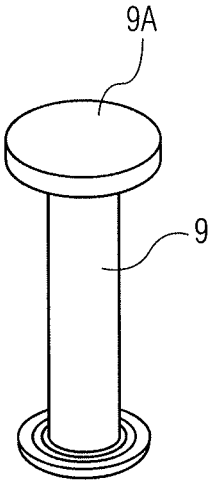

FIG. 14 shows the over-temperature protection leaf spring that is mounted in a channel of the thermal insulator; and FIG. 15 shows the center fastener rivet that is received in the positive-side electrical terminal and, in particular, an eyelet of the positive-side terminal and is riveted to the positive-side terminal to secure all the elements of the socket/outlet together and provides an electrical contact surface for the spring-loaded positive-side terminal of a received electrical plug.

Other objects, features and advantages of the present invention will be apparent from the detailed description which follows.

DETAILED DESCRIPTION OF EMBODIMENTS OF THE INVENTION

Figure 1:
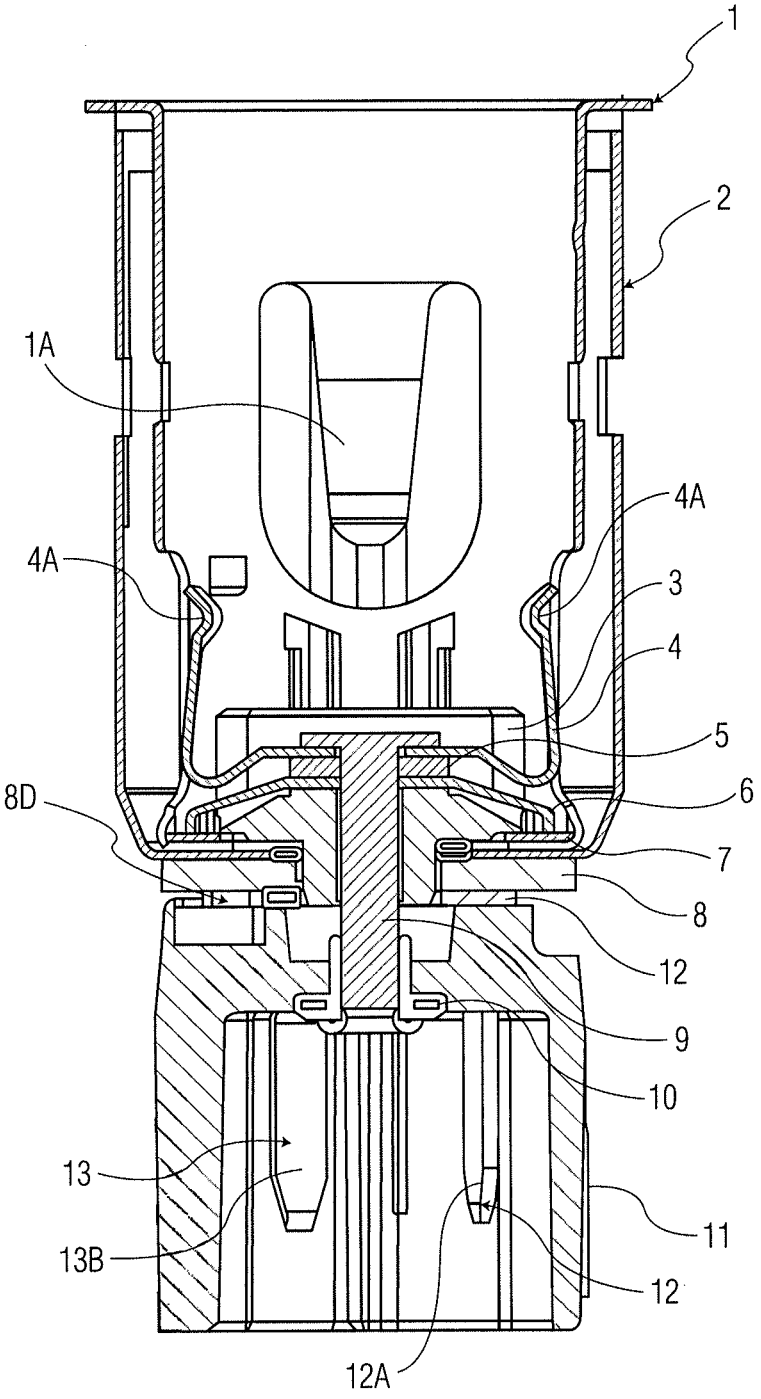
FIG. 1 shows a cross-sectional view of a cigar lighter socket that implements the present invention. The present invention can also be employed, as described above, in an electrical power outlet not equipped as a cigar lighter outlet, which will have a similar design but which will not include certain elements used in a cigar lighter outlet, namely, the heat shield and the bimetal thermostat.

Turning now to FIG. 1, this figure shows a cross-section through the outlet/socket/receptacle of the present invention. FIG. 1 shows the over-temperature/over-current protection features of the present invention employed in a cigar lighter socket but an electric power outlet that is not normally employed as a cigar lighter socket would be essentially the same but would typically eliminate two elements, the heat shield and the bimetal thermostat, as described below.

Figure 2:
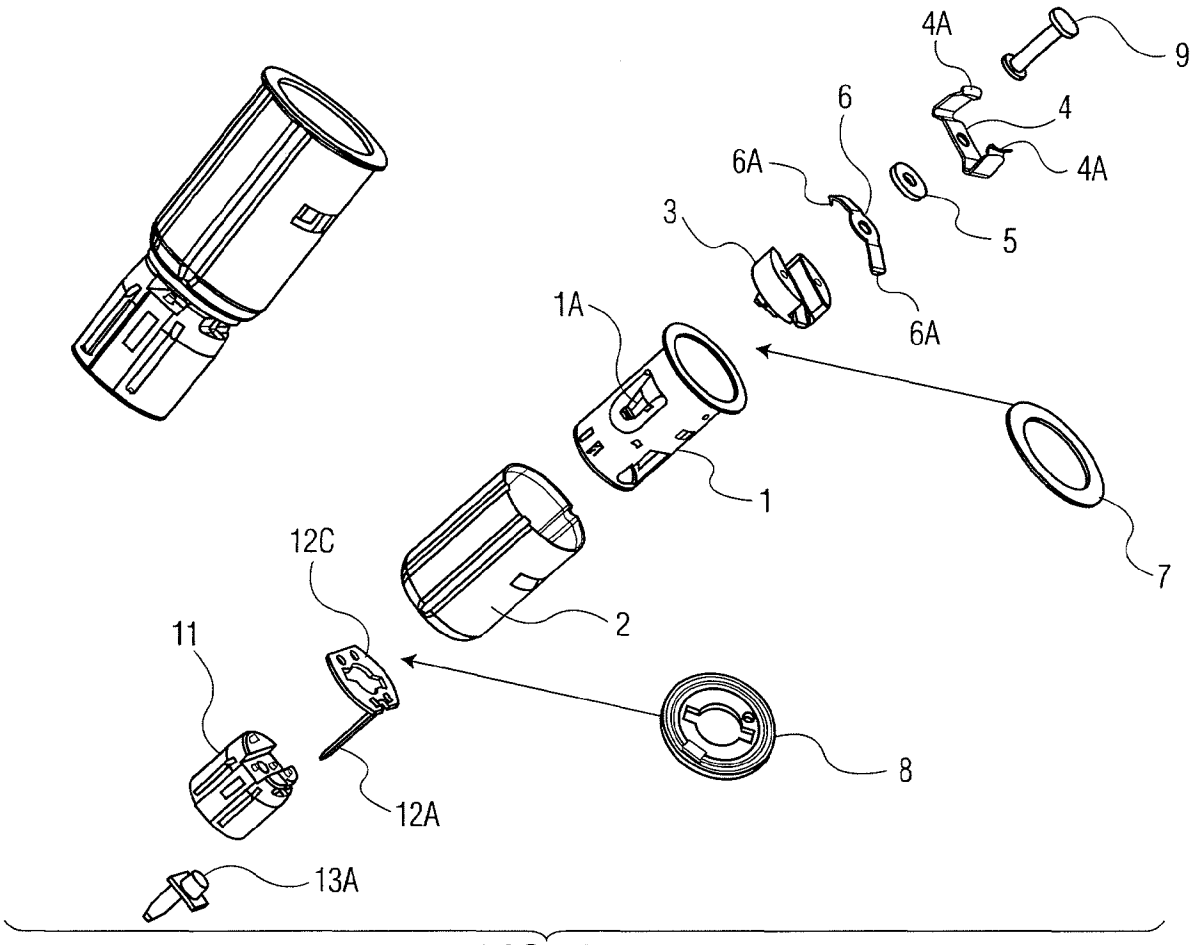
FIG. 2 shows an exploded perspective view of a cigar lighter outlet employing the present invention which is also applicable to an electrical power outlet which would be similar except eliminates components that are typically only used in a cigar lighter outlet, i.e., the heat shield and the bimetal thermostat.

The socket/outlet with over-current and over-temperature protection according to the present invention includes a socket shell 1 that is made of an electrically conductive material, typically steel plated with a rust resistant surface, but any electrically conductive metal that provides adequate temperature safeguards, particularly in the case of a cigar lighter socket, can be employed. Reference is also made to FIG. 2 which shows an exploded view of the outlet/socket/receptacle.

The metal socket 1 is typically connected to the vehicle's negative-side electrical supply. The metal socket may be surrounded by a heat shield 2, in the case of a cigar lighter socket. The heat shield is typically also made of metal, plated for rust resistance, and is typically also in electrical engagement with the metal socket and thus also connected to the negative-side of the vehicle electrical supply.

Mounted centrally within the metal socket 1 is an internal insulator 3, typically a heat resistant or refractory insulator in the case of a cigar lighter socket. The insulator 3 has a center hole through which a center fastener, e.g., a rivet 9, passes. The center rivet 9 also passes through all other components of the outlet/socket and is insulated by the internal insulator 3 from the metal socket and the heat shield but is in electrical engagement with a metal leaf spring 6 to be described in greater detail herein, a metal spacer 5 and a bimetal thermostat 4 that is used in the cigar lighter socket embodiment. In addition, the center rivet 9 passes through but is not electrically connected to the negative-side terminal 12 which has a terminal prong 12A that passes through an opening in an insulating connector housing 11. Mounted to the connector housing 11 and insulated from the negative terminal 12 is a positive-side terminal 13 that has an eyelet 13A. The eyelet 13A receives the distal end of the center rivet 9 and the center rivet 9 is riveted through the eyelet of the positive-side terminal 13 to secure all components of the outlet/socket together.

The invention provides novel over-current and/or over-temperature protection.

In order to provide over-current protection, a fuse member, preferably a printed circuit board (PCB) 8 with integral fuse is disposed between the negative-side terminal 12 and the distal or bottom end of the heat shield, in the case of a cigar lighter socket embodiment, if so provided, or the metal socket 1. If the socket/outlet is not provided with the capability to supply a cigar lighter, then the printed circuit board 8 is disposed between the negative-side terminal 12 and the distal end of the metal socket 1.

Figure 2A:
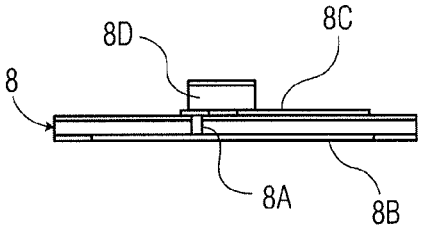
FIG. 2A shows a cross-section through the printed circuit board (PCB) that includes the socket/outlet integrated fuse, here shown as a surface mount technology (SMT) fuse.

As shown in FIG. 2A, the printed circuit board 8 comprises an insulating printed circuit board that includes conductive traces 8B and 8C on respective surfaces of the printed circuit board. In addition, an electrically conductive via 8A is provided connecting one surface trace 8B to the fuse 8D which is connected then to the surface trace 8C on the other side of the PCB. Thus, the fuse 8D is connected in the negative return of the outlet/socket. Preferably the fuse is surface mount technology (SMT). The fuse is preferably selected as a fast-action fuse that will blow faster than the fuse in the vehicle fuse box when there is an over-current.

In addition, as will be explained below, when there is an over-temperature condition and the novel over-temperature protection device of the invention operates to short circuit the socket/outlet, the fuse 8D, because it is connected in the negative return supply of the outlet/socket, will also blow providing the over-temperature protection. Thus, assuming fuse 8D operates more quickly than the fuse in the vehicle fuse box, the over-temperature protection is provided by the combination of the over-temperature protection device provided in the socket according to the present invention causing the integrated fuse 8D to blow. However, it is not necessary to provide both the over-temperature protection device and the over-current protection device according to the invention in the same outlet. Only one protection device can be used depending on the design specification. For example, only the fuse according to the invention may be employed thus providing only over-current protection. Alternatively, only the over-temperature protection device may be employed, in which case the on-board vehicle fuse is used to provide the over-temperature protection when the socket over-temperature protection device according to the invention operates.

The over-temperature protection is preferably provided by a metal leaf spring 6 which is mounted in insulated fashion in a channel of the internal insulator 3 above a thermoplastic disc 7 in the metal socket 1. As shown in FIG. 1, the leaf spring 6 is provided with internal spring bias so that its tips 6A (FIG. 14) are biased against the thermoplastic disc 7. The thermoplastic disc is preferably made of a plastic that does not soften at normal environmental temperatures but only begins to soften at a temperature somewhat below the maximum temperature to be protected against. The disc may comprise POM (acetal) which has a melting point around 170° C. When the socket approaches over-temperature conditions, the tips 6A of the leaf spring, which may be of reduced surface area compared to the thickness of the metal of the leaf spring, i.e., the tips 6A may be made somewhat pointed or sharpened in order to penetrate the thermoplastic, will penetrate through the thermoplastic disc and electrically engage with the bottom of the metal socket well 1 which is connected to the negative side of the vehicle electrical supply. Since the leaf spring 6 is connected to the positive side of the electrical supply by the center rivet 9 and positive terminal 13, the vehicle electrical supply is short-circuited, causing the fuse 8D on the printed circuit board to blow (or the on board vehicle fuse to blow if fuse 8D is not provided), thereby providing over-temperature protection. A suitable temperature range at which the over-temperature protection operates is about 170° C.-180° C.

Figure 2B:
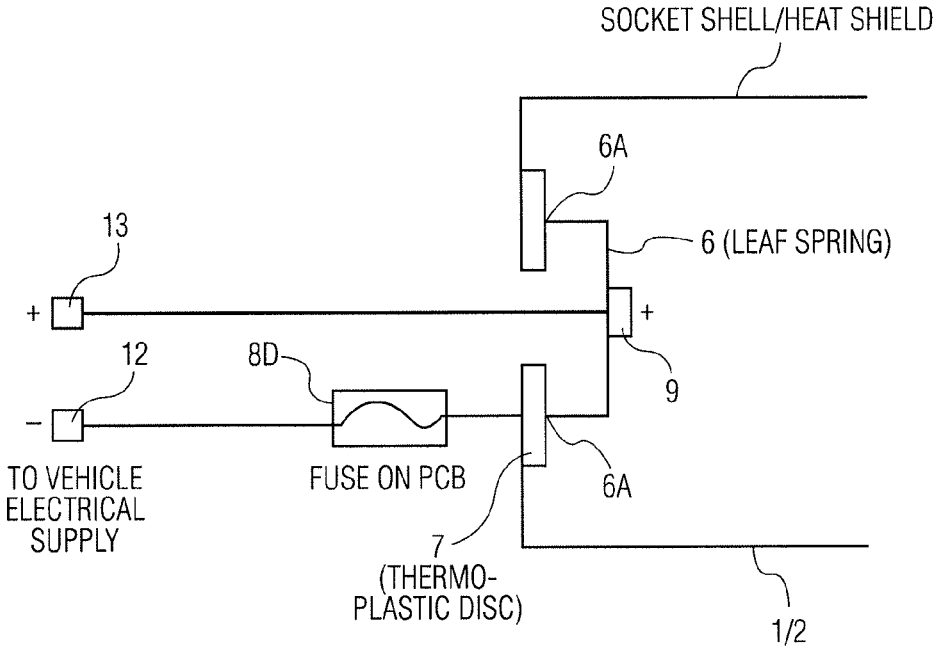
FIG. 2B shows a schematic diagram of the electrical wiring of the socket showing the over-temperature protection provided by the leaf spring and thermoplastic disc as well as the series connected over-current protection integrated fuse located on the printed circuit board.

This is shown in schematic form by the electrical diagram in FIG. 2B.

In FIG. 2, thermoplastic disc 7 is shown enlarged somewhat from the scale of the metal socket 1. The thermoplastic disc 7 has an outside diameter such that it can be located at the bottom of the metal socket and has an outside diameter that provides a clearance fit in the inside diameter of the metal socket.

The printed circuit board 8 that contains the SMT fuse 8D is disposed below the heat shield in a cigar lighter socket embodiment if the heat shield is employed or below the metal socket 1 if the socket is not a cigar lighter socket or does not have a heat shield.

On the other side of the printed circuit board 8, the negative terminal 12 is disposed. The negative terminal 12 has a disc-like planar portion 12C and a terminal end 12A. The planar portion 12C is electrically in contact with one of the traces on the printed circuit board. In particular, it is in contact with the trace 8C on the printed circuit board 8 and thus in series electrical connection with the SMT fuse 8D. The SMT fuse is in series connection with an electrical via 8A which in turn is connected to the electrical trace 8B on the other side of the PCB.

The electrical trace 8C in the embodiment shown is in electrical contact with the negative-side terminal 12 and the electrical trace 8B is in electrical contact with the heat shield 2, if provided, or the metal socket 1. The fuse 8D is thus in series relationship with the metal socket and the negative-side terminal 12 and in the return side of the vehicle electrical supply.

In the case of an over-current condition, with or without an over-temperature condition, the fuse 8D will blow. The fuse is selected to provide faster action than the fuse in the vehicle fuse box and is sized such that it provides for a maximum current carrying capacity.

In the event of an over-temperature condition, as explained above, the metal leaf spring will provide a short-circuit by penetrating through the softened thermoplastic disc 7 thus causing the short-circuit which will then cause an over-current condition, blowing the fuse 8D, if so provided, or the vehicle on-board fuse.

Thus, the present invention provides both for over-current protection as well as over-temperature protection, in the preferred embodiment. However, it should be apparent to those of skill in the art that both means of protection need not be employed, depending on the specification. For example, the invention can be provided with only the over-current protection fuse mechanism and not the over-temperature protection mechanism which is provided by the metal leaf spring 6 and the thermoplastic disc 7. Such an embodiment employing only the over-current fuse protection may be especially applicable to cigar lighter sockets which typically already employ over-temperature protection in the form of bimetal thermostats that are adapted to short circuit the outlet in the event of an over-temperature condition that is higher than the normal temperatures achieved in electrical cigar lighter outlets when the cigar lighter reaches ignition temperature.

Conversely, it may be desirable in certain situations only to provide for the over-temperature protection mechanism, that is, the metal leaf spring 6 and thermoplastic disc 7 of the preferred embodiment, and not provide the integrated fuse and merely rely on the vehicle fuse box fuse to provide the over-temperature protection when the leaf spring 6 short circuits through the thermoplastic disc 7 to the metal socket 1 in the case of the over-temperature condition.

However, the preferred embodiment of the present invention provides the integral over-current protection fuse as well as integral over-temperature protection as described. This is particularly suited for use in an electrical power outlet which is not used as a cigar lighter receptacle because the present invention provides a relatively fast acting over-temperature protection mechanism through the combination of the over-temperature protection leaf spring 6 and thermoplastic disc 7 and integrated fuse 8D.

Figure 3:
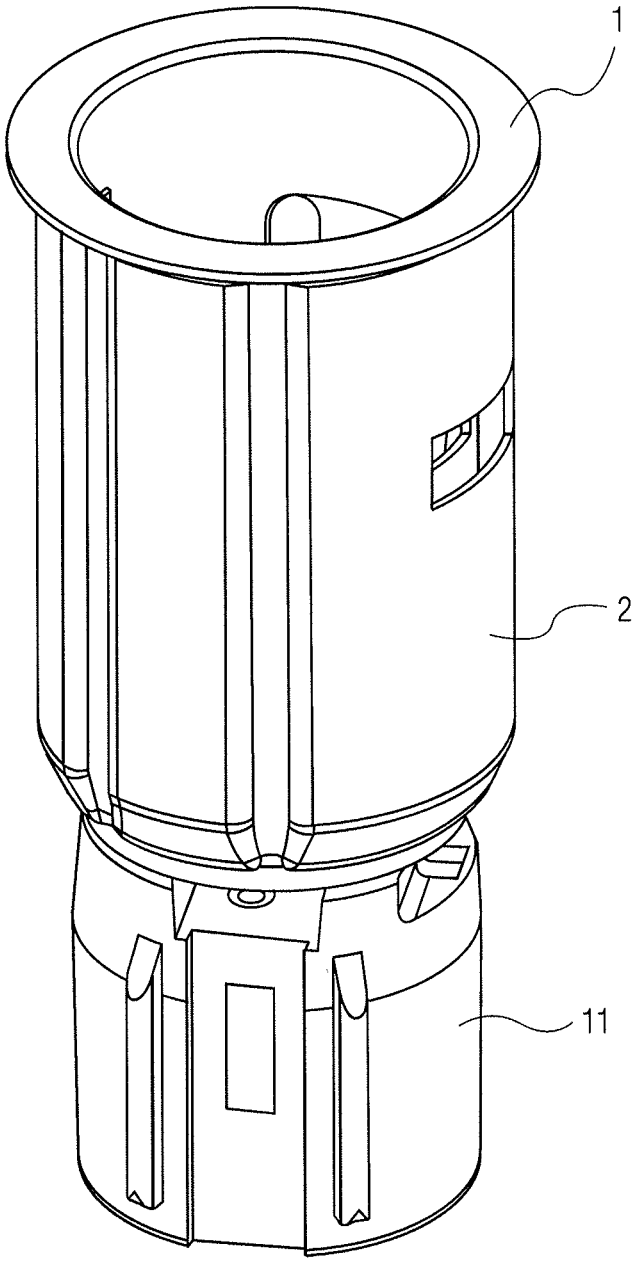
FIG. 3 shows a perspective view of the socket/outlet.

FIG. 3 shows the assembled electrical power outlet/cigar lighter socket showing the metal socket shell 1, the external heat shield 2 and the insulating electrical terminal connector 11.

Figure 5:
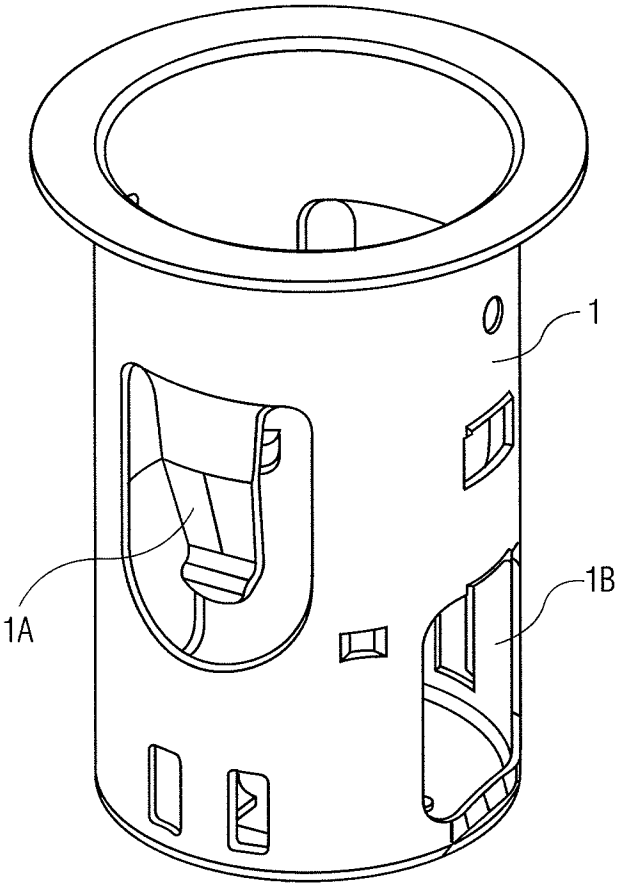
FIG. 5 shows the socket metal shell.
Figure 4:
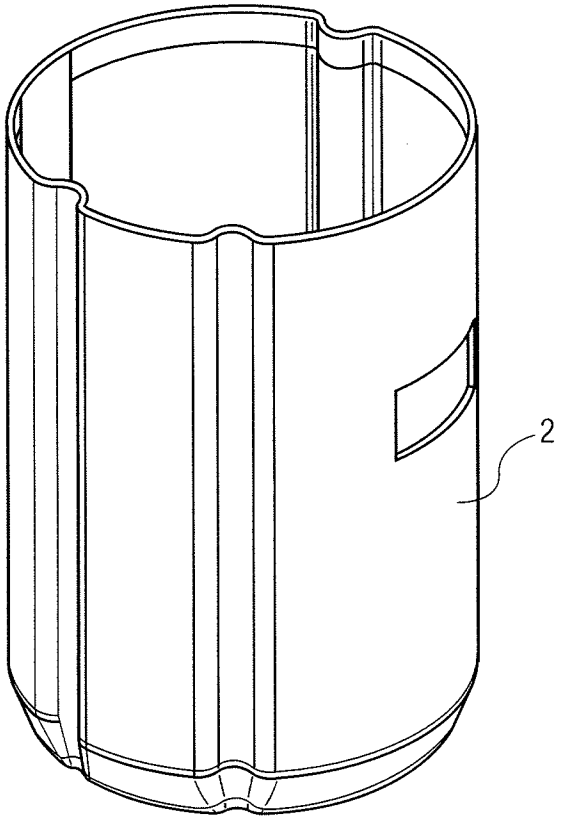
FIG. 4 shows the heat shield which is used typically only in the lighter socket embodiment.

FIG. 4 shows the heat shield 2, which may be employed in the lighter socket embodiment. FIG. 5 shows the metal socket 1 in more detail. The metal socket 1 includes inwardly biased lances 1A which are adapted to hold the cigar lighter or accessory plug in mechanical engagement in the socket so that the plug or lighter does not fall out of the socket and is effectively held in the socket. These lances also provide for more positive electrical contact with the negative-side of the inserted lighter. Typically, the negative-side contact with an inserted electrical accessory plug is provided by spring loaded contacts on the known accessory plug that engage with the inner wall of the socket 1.

In addition, openings 1B on opposite sides of the socket shell 1 are provided opposite the clips 4A of the bimetal thermostat 4 to provide for radial movement of the thermostat clips 4A when the clips expand due to heating action to release the lighter. In the case of an electrical power outlet that is not capable of energizing a lighter, the openings 1B can be eliminated.

Figure 6:
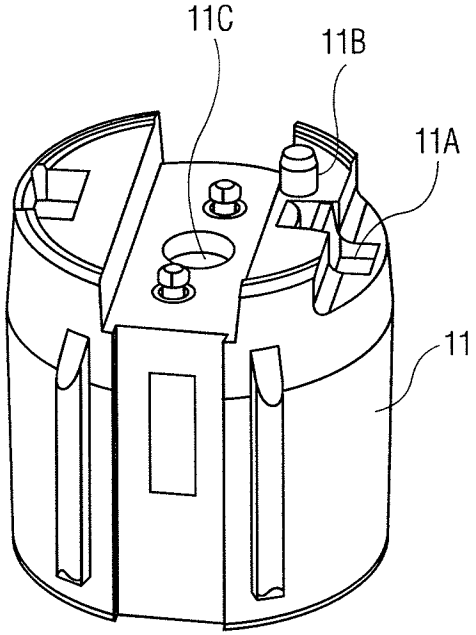
FIG. 6 shows the insulated electrical connector housing provided at the rear of the socket/outlet.

FIG. 6 shows the electrical connector housing insulator 11.

Figure 7:
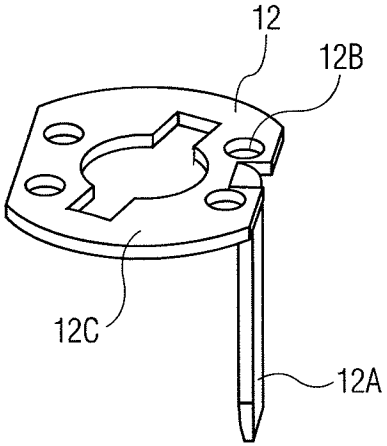
FIG. 7 shows one of the electrical terminals, typically the negative-side terminal.

FIG. 7 shows the negative-side terminal 12. In particular, the terminal end 12A is received in an opening 11A of the insulator 11 and a projection 11B on the insulator 11 is adapted to position the negative terminal 12 by being received through an opening 12B in the terminal 12. The terminal 12 has the planar disc-like portion 12C, as previously described for contacting the PCB 8 having the fuse element 8D.

The terminal end 12A is connected typically to the negative-side vehicle electrical supply.

Figure 8:
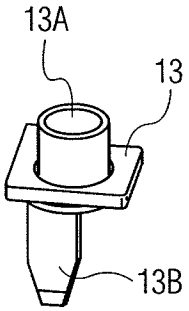
FIG. 8 shows the other electrical terminal, typically the positive-side terminal.

FIG. 8 shows the positive-side terminal 13. The eyelet 13A is adapted to be received through the center opening 11C in the insulator 11 and receives the center rivet 9. Terminal end 13B is connected typically to the positive-side of the vehicle electrical supply.

Figure 9:
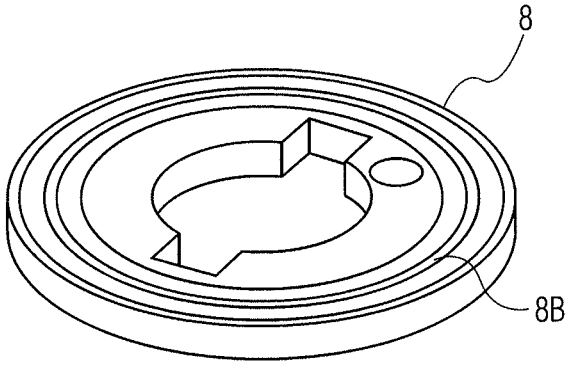
FIG. 9 is a perspective view showing in greater detail the printed circuit board.
Figure 9A:
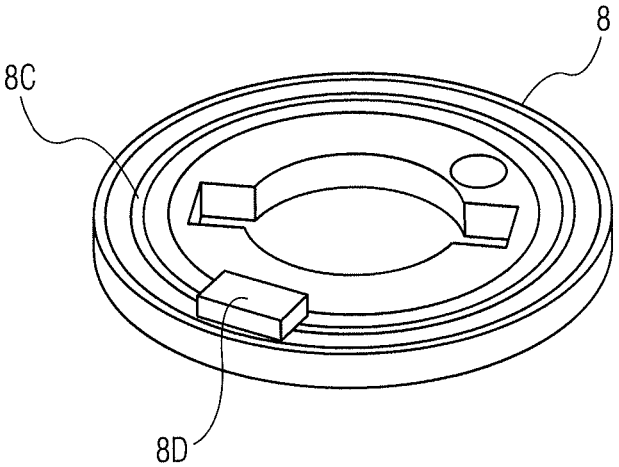
FIG. 9A is a perspective view showing the other side of the printed circuit board showing the fuse.

FIGS. 9 and 9A show the PCB that contains the fuse 8D. The PCB 8 includes a trace 8B on one side and a trace 8C on the other side. The trace 8B is electrically connected through an electrically conductive via 8A not visible in FIGS. 9 and 9A to the fuse 8D which in turn is electrically connected to the electrical trace 8C. The trace 8C is in electrical contact with the negative-side electrical terminal 12. The trace 8B is in electrical contact with the socket well 1 and/or heat shield 2 if provided.

Figure 10:
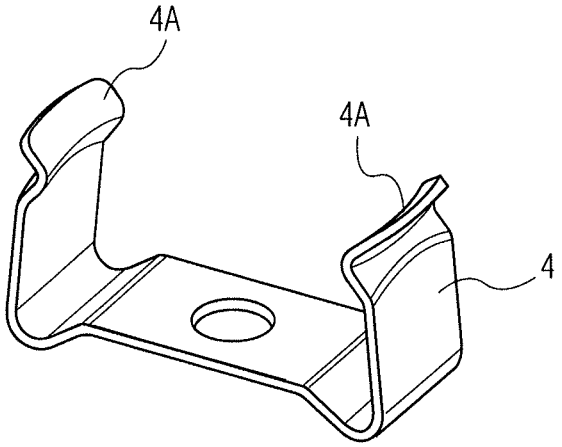
FIG. 10 shows the bimetal thermostat that is used in the lighter socket embodiment but not employed in a non-lighter socket power outlet.

FIG. 10 shows the bimetal thermostat 4 provided if the socket is a cigar lighter receptacle.

Figure 11:
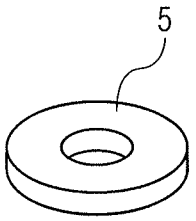
FIG. 11 shows a metal spacer/washer that is used between the over-temperature protection device, that is, the metal leaf spring, and the bimetal thermostat of FIG. 10, if so provided.

FIG. 11 shows a metal spacer 5 that is provided between the over-temperature protection leaf spring 6 and the bimetal thermostat 4 in the preferred embodiment. The spacer 5 is provided to prevent interference between the leaf spring 6 and the bimetal thermostat and to facilitate electrical/thermal connection between the two parts. The spacer can be eliminated, and furthermore, may not be necessary in a non-lighter socket embodiment.

Figure 12:
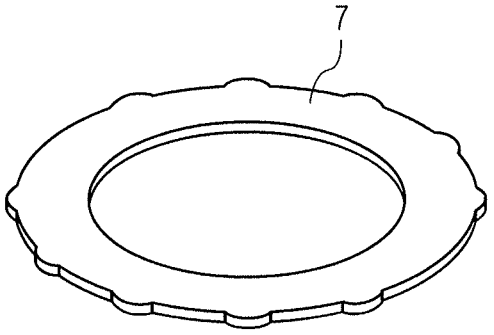
FIG. 12 shows the thermoplastic disc against which the over-temperature protection leaf spring rests in spring biased engagement.

FIG. 12 shows the thermoplastic disc 7 that is located at the bottom of the socket well 1 and on which the thermal protection leaf spring 6 impinges.

Figure 13:
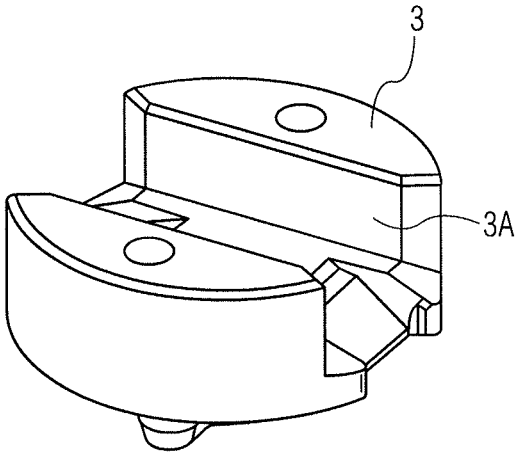
FIG. 13 shows the thermal insulator upon which the metal leaf spring rests and which electrically isolates the leaf spring and bimetal thermostat in the lighter socket embodiment from the metal socket.

FIG. 13 shows the internal insulator 3 provided with a channel 3A for the leaf spring 6 and thermostat 4, if so provided.

FIG. 14 shows the leaf spring 6 which rests in the channel 3A of the internal insulator 3.

Finally, FIG. 15 shows the center fastener, e.g., rivet 9, which is employed to hold all elements of the socket/outlet together. It also is connected to the positive-side of the vehicle electrical supply and its head 9A is employed to provide electrical contact to a spring-loaded contact of an electrical accessory plug of an electrical/electronic device that is plugged into the outlet.

When the integrated fuse 8D blows or the thermal protection device 6/7 operates, the electrical outlet is replaced with a new one.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electrical outlet comprising:

a conductive socket well for slidably receiving an electrical plug, the well having a transverse distal end having a center hole;

an insulating connector housing adjacent the transverse distal end of the socket well having at least two electrical terminals for connection to an electrical supply;

a first of said electrical terminals being coupled to a central fastener and a second of said electrical terminals terminating in a conductive element adjacent the transverse distal end of the socket well;

a fuse member being provided between the transverse distal end of the socket well and said conductive element, the fuse member in series electrical connection between the conductive element and the socket well, the fuse member providing an electrical conduction path between the second electrical terminal and the socket well;

further comprising an insulator disposed at the distal end of the socket well in the socket well, the central fastener holding the socket well, the insulator, the fuse member, insulating connector housing and first and second electrical terminals together as a unit;

a proximal end of the central fastener providing a first electrical contact insulated from said socket well and the socket well providing a second electrical contact for electrically contacting with respective contacts of the electrical plug received in the socket well;

the fuse member providing integral over-current protection for the electrical outlet, the fuse member interrupting the series electrical connection in the event of an over-current condition;

wherein the fuse member comprises an insulating member having first and second electrically conductive sides and a fuse element in series connection with the first and second electrically conductive sides, the first and second electrically conductive sides being in respective electrical contact with the socket well and the conductive element of the second electrical terminal, the conductive element comprising a planar conductive element;

further wherein the insulating member comprises a printed circuit board and the electrically conductive sides comprises first and second electrically conductive traces disposed on respective sides of the circuit board, the fuse element being mounted on the circuit board, and wherein the fuse element comprises a surface mount technology (SMT) fuse mounted to the printed circuit board.

2. The electrical outlet of claim 1, further comprising an electrical via formed through the printed circuit board connecting the first and second conductive traces.

3. The electrical outlet of claim 1, wherein the first electrical terminal is connected to a positive-side of a DC voltage supply and the second electrical terminal is connected to a negative-side of the DC voltage supply, whereby the fuse member is connected in series in the negative return side to the DC voltage supply.

4. The electrical outlet of claim 3, wherein the DC voltage supply is the electrical supply of a motor vehicle and the electrical outlet comprises an electrical power receptacle in a motor vehicle.

5. The electrical outlet of claim 1, further comprising an over-temperature protection mechanism in the electrical outlet.

6. The electrical outlet of claim 1, wherein the fuse member is tamper proof.

7. An electrical outlet comprising:

a conductive socket well for slidably receiving an electrical plug, the well having a transverse distal end having a center hole;

an insulating connector housing adjacent the transverse distal end of the socket well having at least two electrical terminals for connection to an electrical supply;

a first of said electrical terminals being coupled to a central fastener and a second of said electrical terminals terminating in a conductive element adjacent the transverse distal end of the socket well;

a fuse member being provided between the transverse distal end of the socket well and said conductive element, the fuse member in series electrical connection between the conductive element and the socket well, the fuse member providing an electrical conduction path between the second electrical terminal and the socket well;

further comprising an insulator disposed at the distal end of the socket well in the socket well, the central fastener holding the socket well, the insulator, the fuse member, insulating connector housing and first and second electrical terminals together as a unit;

a proximal end of the central fastener providing a first electrical contact insulated from said socket well and the socket well providing a second electrical contact for electrically contacting with respective contacts of the electrical plug received in the socket well;

the fuse member providing integral over-current protection for the electrical outlet;

further comprising an over-temperature protection mechanism in the electrical outlet that is a different mechanism than said fuse member;

wherein the over-temperature protection mechanism comprises a thermoplastic insulating disc at the distal end of the socket well mounted between the insulator in the socket well and the transverse distal end of the socket well and being held in place by the central fastener disposed through a central hole of the thermoplastic insulating disc, further comprising a spring-loaded member electrically and mechanically connected to the central fastener and held in place in the insulator by the central fastener, the spring-loaded member biased against the thermoplastic insulating disc, the thermoplastic insulating disc having a melting point above a normal temperature range of use of the electrical outlet but below a threshold maximum temperature, whereby the thermoplastic insulating disc will soften at the maximum temperature and the spring-loaded member biased against the thermoplastic insulating disc will form an electrically conductive path through the thermoplastic insulating disc and electrically engage the transverse distal end of the socket well thereby short-circuiting the electrical supply and blowing the fuse member to provide over-temperature protection.

8. The electrical outlet of claim 7, wherein the spring-loaded member comprises a leaf spring having first and second transverse arms and right angle ends directed to the thermoplastic insulating disc for penetrating through the thermoplastic insulating disc when the thermoplastic insulating disc softens at the threshold maximum temperature, the right angle ends having contact points for electrically engaging with the transverse distal end of the socket well when the thermoplastic insulating disc softens, further wherein the leaf spring has a center hole for electrical and mechanical engagement by the central fastener.

9. The electrical outlet of claim 8, wherein heat from an overheating electrical plug transfers from the central fastener to the leaf spring to thereby allow the leaf spring to heat up and penetrate through the thermoplastic insulating disc when the threshold maximum temperature is reached.

10. The electrical outlet of claim 8, further comprising a bimetal thermostat engaging device having a least two clips for engaging the electrical plug, and wherein the electrical plug comprises a cigar lighter, the bimetal thermostat being electrically and mechanically engaged by the central fastener, the bimetal thermostat clips moving radially outwardly to release the cigar lighter from electrical and mechanical engagement with the clips when an ignition temperature of the cigar lighter has been reached.

11. The electrical outlet of claim 10, further comprising an electrically conductive spacer between the bimetal thermostat and the leaf spring.

12. An electrical outlet comprising:

a conductive socket well for slidably receiving an electrical plug, the well having a transverse distal end having a center hole;

an insulating connector housing adjacent the transverse distal end of the socket well having at least two electrical terminals for connection to an electrical supply;

a first of said electrical terminals being coupled to a central fastener and a second of said electrical terminals in electrical contact with the socket well;

further comprising an insulator disposed at the distal end of the socket well in the socket well, the central fastener holding the socket well, the insulator, the insulating connector housing and first and second electrical terminals together as a unit;

a proximal end of the central fastener providing a first electrical contact insulated from said socket well and the socket well providing a second electrical contact for electrically contacting with respective contacts of the electrical plug received in the socket well;

further comprising a thermoplastic insulating disc at the distal end of the socket well mounted between the insulator in the socket well and the transverse distal end of the socket well and being held in place by the central fastener disposed through a central hole of the thermoplastic insulating disc, further comprising a spring-loaded member electrically and mechanically connected to the central fastener and held in place in the insulator by the central fastener, the spring-loaded member biased against the thermoplastic insulating disc, the thermoplastic insulating disc having a melting point above a normal temperature range of use of the electrical outlet but below a threshold maximum temperature, whereby the thermoplastic insulating disc will soften at the maximum temperature and the spring-loaded element biased against the thermoplastic insulating disc will form an electrically conductive path through the thermoplastic insulating disc and electrically engage the transverse distal end of the socket well thereby short-circuiting the electrical supply and causing circuit interruption to provide over-temperature protection, further comprising an over-current protection mechanism disposed in said electrical outlet that is a different mechanism than said thermoplastic insulating disc.

13. The electrical outlet of claim 12, wherein the spring-loaded member comprises a leaf spring having first and second transverse arms and right angle ends directed to the thermoplastic disc for penetrating through the thermoplastic disc when the disc softens at the threshold maximum temperature, the right angle ends having contact points for electrically engaging with the transverse distal end of the socket well when the thermoplastic disc softens, further wherein the leaf spring has a center hole for electrical and mechanical engagement by the central fastener.

14. The electrical outlet of claim 13, wherein heat from an overheating electrical plug transfers from the central fastener to the leaf spring to thereby allow the leaf spring to penetrate through the thermoplastic disc when the threshold maximum temperature is reached.

15. The electrical outlet of claim 13, further comprising a bimetal thermostat engaging device having a least two clips for engaging the electrical plug, and wherein the electrical plug comprises a cigar lighter, the bimetal thermostat being electrically and mechanically engaged by the central fastener, the bimetal thermostat clips moving radially outwardly to release the cigar lighter from electrical and mechanical engagement with the clips when an ignition temperature of the cigar lighter has been reached.

16. The electrical outlet of claim 15, further comprising an electrically conductive spacer between the bimetal thermostat and the leaf spring.

17. The electrical outlet of claim 12, further comprising a heat shield surrounding the socket well.

18. The electrical outlet of claim 12, wherein the over-current protection mechanism comprises a fuse member provided between the transverse distal end of the socket well and the second electrical terminal and said fuse member comprises the fuse that blows to provide over-temperature protection.

19. The electrical outlet of claim 18, wherein the first electrical terminal is connected to a positive side of a DC voltage supply and the second electrical terminal is connected to a negative side of the DC voltage supply, whereby the fuse member is connected in series in the negative return side to the DC voltage supply.

20. The electrical outlet of claim 19, wherein the DC voltage supply is the electrical supply of a motor vehicle and the electrical outlet comprises an electrical power receptacle in a motor vehicle.

21. The electrical outlet of claim 18, wherein the fuse member comprises an insulating member having first and second electrically conductive sides and a fuse element in series connection with the first and second electrically conductive sides, the first and second electrically conductive sides being in respective electrical contact with the socket well and the second electrical terminal.

22. The electrical outlet of claim 21, wherein the insulating member comprises a circuit board and the electrically conductive sides comprises first and second electrically conductive traces disposed on respective sides of the circuit board, the fuse element being mounted on the circuit board.

23. The electrical outlet of claim 22, wherein the circuit board comprises a printed circuit board and the fuse element comprises a surface mount technology (SMT) fuse mounted to the printed circuit board.

24. The electrical outlet of claim 23, further comprising an electrical via formed through the printed circuit board connecting the first and second conductive traces.

25. The electrical outlet of claim 21, wherein the second electrical terminal has a planar conductive element in electrical contact with one of said electrically conductive sides of said fuse member.

26. An electrical outlet comprising:

a conductive socket well for slidably receiving an electrical plug, the well having a transverse distal end having a center hole;

an insulating connector housing adjacent the transverse distal end of the socket well having at least two electrical terminals for connection to an electrical supply;

a first of said electrical terminals being coupled to a central fastener and a second of said electrical terminals terminating in a conductive element adjacent the transverse distal end of the socket well;

a fuse member being provided between the transverse distal end of the socket well and said conductive element, the fuse member in series electrical connection between the conductive element and the socket well, the fuse member providing an electrical conduction path between the second electrical terminal and the socket well;

further comprising an insulator disposed at the distal end of the socket well in the socket well, the central fastener holding the socket well, the insulator, the fuse member, insulating connector housing and first and second electrical terminals together as a unit;

a proximal end of the central fastener providing a first electrical contact insulated from said socket well and the socket well providing a second electrical contact for electrically contacting with respective contacts of the electrical plug received in the socket well;

the fuse member providing integral over-current protection for the electrical outlet, the fuse member interrupting the series electrical connection in the event of an over-current condition;

wherein the fuse member comprises an insulating member having first and second electrically conductive sides and a fuse element in series connection with the first and second electrically conductive sides, the first and second electrically conductive sides being in respective electrical contact with the socket well and the conductive element of the second electrical terminal, the conductive element comprising a planar conductive element;

further wherein the insulating member comprises a printed circuit board and the electrically conductive sides comprises first and second electrically conductive traces disposed on respective sides of the circuit board, the fuse element being mounted on the circuit board.

27. The electrical outlet of claim 26, further comprising an over-temperature protection mechanism in the electrical outlet.

* * * * *